United States Patent [19]

Ogura

[11] 4,232,786

[45] Nov. 11, 1980

[54] CASE FOR A TAPE

[76] Inventor: Kiyoshi Ogura, 1-7-203, 2-cho, Takeshirodai, Sakai-shi, Osaka-fu, Japan

[21] Appl. No.: 28,794

[22] Filed: Apr. 10, 1979

[30] Foreign Application Priority Data

Jul. 12, 1978 [JP] Japan ..... 53-96674[U]
Oct. 30, 1978 [JP] Japan ..... 53-149895[U]

[51] Int. Cl.[3] ..... B65D 85/671
[52] U.S. Cl. ..... 206/409
[58] Field of Search ..... 112/138; 206/389, 409, 206/461, 806; 229/17 S

[56] References Cited

U.S. PATENT DOCUMENTS

| | | | |
|---|---|---|---|
| 1,207,977 | 12/1916 | Moffatt | 112/138 |
| 2,175,493 | 10/1939 | Thompson | 112/138 |
| 3,218,003 | 11/1965 | Bradshaw | 206/409 X |
| 3,403,869 | 10/1968 | Marchison et al. | 206/409 X |
| 3,754,643 | 8/1973 | Foster | 206/409 X |
| 3,881,257 | 5/1975 | Chasen | 206/461 X |

FOREIGN PATENT DOCUMENTS

| | | | |
|---|---|---|---|
| 812177 | 5/1937 | France | 206/409 |
| 1468036 | 12/1966 | France | 206/467 |

*Primary Examiner*—Donald F. Norton
*Attorney, Agent, or Firm*—Wenderoth, Lind & Ponack

[57] ABSTRACT

A case for a tape includes a base sheet, a cover fixed onto the base sheet and enclosing a roll of tape therein, and a guide extending from the cover and having an open end for dispensing the tape therethrough. The guide has a bent portion between the cover and the open end, the guide being shaped for first guiding the tape tangentially to the roll of the tape, and then changing its course toward the open end. When the case is for a bias tape it has the guide tapering toward the open end, and a slit extending from the open end toward the cover beyond the bent portion along the guide, thereby further folding down the tape longitudinally as the tape is pulled forward and passed through the guide.

5 Claims, 3 Drawing Figures

CASE FOR A TAPE

The present invention relates to a case for a tape e.g. for edging for a piece of cloth, more particularly, a case for a bias tape.

A tape, in particular, a bias tape, has been conventionally provided in a roll wound around a panel for use, but as a matter of fact, difficulties arise when using the tape provided in this manner. Thus, the invention has proposed a few newly developed cases for such a tape, as disclosed in Japanese utility model applications No. 96674/1978 and No. 127761/1978, in which the case has the tape in a roll therein and the tape is pulled out of the case tangentially to the roll. However, the case still has a disadvantage in that the case itself somewhat hinders smooth use after dispensing, for example, smooth machining, since the case is in a position on a tangential extension of the tape roll.

It is, therefore, an object of the present invention to obviate the above difficulty, and to provide a more improved case for a tape which has a construction such that the case will not hinder smooth work and the tape will be directed immediately to the work when pulled out of the case.

Other objects and feature of the invention will be apparent from the following description taken in connection with the accompanying drawings, in which.

Figure 1:
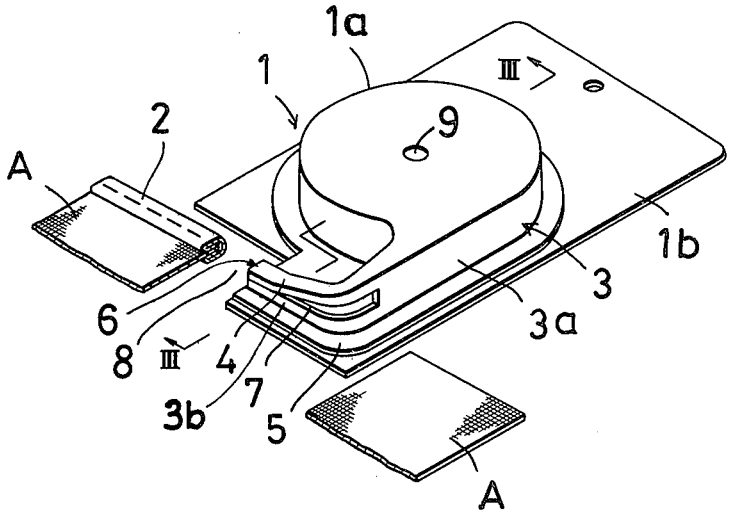
FIG. 1 is a perspective view of an embodiment of a case for a tape according to the invention.
Figure 2:
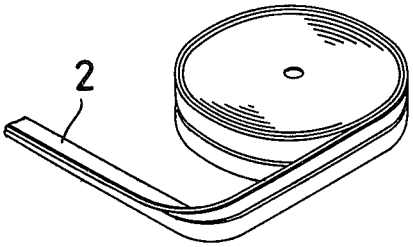
FIG. 2 is a perspective view of the tape folded lengthwise as it is dispensed from the case according to the invention.
Figure 3:
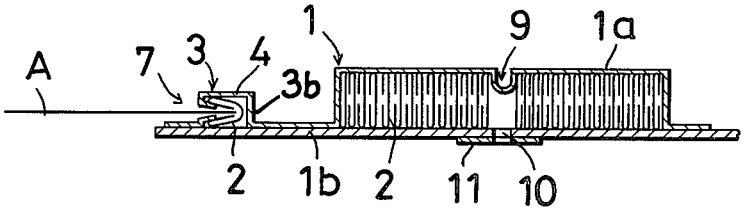
FIG. 3 is a sectional view of the case taken on line III—III of FIG. 1.

Referring first to FIG. 1, there is illustrated a case 1 according to the invention which comprises a cover 1*a* and a base sheet 1*b*. The cover is molded preferably of a transparent synthetic resin, and is fixedly secured onto the base sheet to enclose a roll of tape 2 therein, so that the tape can be seen through the cover. The base sheet is, for example, of cardboard. If desired, the case can be formed so as to be divided into two parts.

In the drawing, a bias tape is illustrated as an example of the tape enclosed in the case, and is enclosed in the case in roll with both the side edges thereof folded over longitudinally with the side edges opposed to each other on the outer face of the tape along the center line thereof.

The cover has a hollow guide 3 formed integrally therewith as an extension thereof for guiding the tape tangentially to the roll of the tape when the tape is pulled off the roll. That is, the guide acts as a passage for containing and guiding the tape when it is pulled out of the case. The guide 3 has a tangential portion 3*a*, a bend 5 and an end portion 3*b* extending from the bend 5 substantially perpendicular to the tangential portion 3*a* adjacent the cover 1*a* and terminating in an open end 6 at the free end thereof. As the tape is drawn out of the case, it first moves along the tangential portion in the condition as it is drawn off the roll, i.e. flat, and then the inner face of the tape is bent around the inside of the bend 5 and then directed along the end portion 3*b*. The guide further has a top wall 4 and the portion thereof extending from the bend 5 to the open end 6 is inclined downwardly toward the base sheet 1*b*, thus tapering the guide. After the tape passes bend 5, it is folded with the edges facing away from the roll, and the tapering guide forces the tape to be further folded around the center line thereof as the tape passes through the guide. Since the tape is initially provided with the outer end protruding in the folded condition from the open end of the guide, the tape remains folded in this manner as it is pulled out of the open end continuously so that it is ready for immediate use.

A slit 7 is provided in the outer side wall of the guide about in the middle of the height thereof. The slit extends along the end portion 3*b* from the opening 6 toward the bend 5 and ends just past the bent portion. Therefore, the slit permits the easy insertion of the edge of a piece of cloth A to be edged by the tape which is being folded by the inclined top wall of the guide. Furthermore, since the slit extends beyond the bend toward the case, the cloth can be readily inserted into the slit in the direction of the movement of the tape. Also since the tape is only incompletely folded down at the bent portion, the cloth is naturally and surely inserted between the tape.

According to the invention, a corner of the base sheet is cut away to leave a rectangular space 8 so that the base sheet has an edge even with the open end 6 of the guide 3, and sewing by machine, for example, can be performed at a position spaced slightly from the open end 6.

The cover has on the inner face thereof a projection 9 extending inwardly therefrom for serving as a bearing for the roll of tape when the tape is pulled off the roll. In turn, the base sheet has an opening 10 under the projection in alignment therewith to hold a shaft therein for fixing the case together with the tape on a work table for machining. The opening may be initially sealed by a seal 11 if desired. The seal is removed from the base sheet for fixing the case on the table.

In using the tape, the protruding outer end of the tape is further pulled from the open end of the guide while cloth to be hemmed is inserted into the slit in the direction of tape movement at the bend of the guide. Then, the tape is further pulled forward together with the cloth therebetween, and the portion protruding from the open end of the guide is immediately machined or hemmed.

As has been fully set forth herein, the case of the invention has a guide for changing the direction of the tape pulled off the roll tangentially thereto. Thus, the case is not on an extension of the tape pulled out therefrom, and will not hinder smooth use of the tape. For example, the case can be put on the right while cloth to be hemmed is put on the left so that a sewing machine needle operates at a spaced slightly from the open end of the guide. It is apparent that the sewing can be smoothly conducted.

Furthermore, because the guide has the tapering passage to further fold the tape, and the slit to receive the cloth to be hemmed so that the cloth is positioned between the tape, the cloth can be hemmed with the tape continuously as the cloth is pulled forward continuously together with the thus folded bias tape.

What is claimed is:

1. A package comprising:

a base sheet;

a cover fixed on said base sheet;

a roll of tape enclosed within said cover; and a guide on said base sheet having a tangential portion extending from said case in a direction tangent to said roll, an end portion extending from the free end of said tangential portion and adjacent said cover and being open at the free end thereof, and a bend joining said tangential portion and said end portion, said end portion having a top wall inclined toward said base sheet from said bend to said open end, the tape extending tangentially from the roll through said tangential portion to said bend in the condition as drawn off said roll and having the inner face bent around said bend and having the portion extending along said end portion folded with the edges facing away from said roll, whereby when the tape is pulled from said open end, it is folded with the opening of the fold facing away from the roll.

2. A package as claimed in claim 1 in which said guide has a slit in the sidewall thereof on the side facing away from said roll and extending from said open end of said end portion to and past said bend for receiving the edge of a piece of material which is to have the folded tape placed thereover.

3. A package as claimed in claim 2, in which said tape is a bias tape having the edges thereof folded over against the outer face of the tape in said roll.

4. A package as claimed in claim 1 in which said base sheet has a portion adjacent the open end of said end portion cut away with an edge of said sheet along said cut away portion being in alignment with said open end.

5. A package as claimed in claim 1 in which said cover has a projection on the inner face thereof on which said roll of tape is mounted for serving as a bearing for said roll of tape as said tape is unrolled, and said base sheet has an opening thereon aligned with said projection for receiving a shaft for mounting said package on a work table.

* * * * *